US005516334A

United States Patent [19]

Easton

[11] Patent Number: 5,516,334

[45] Date of Patent: May 14, 1996

[54] INTERACTIVE EXERCISE MONITOR

[76] Inventor: Gregory D. Easton, 2985 Mount Herman Rd., Monument, Colo. 80132

[21] Appl. No.: 188,217

[22] Filed: Jan. 28, 1994

[51] Int. Cl.[6] ..... A63B 71/00

[52] U.S. Cl. ..... 482/8; 482/3; 482/14; 482/902; 340/323 R

[58] Field of Search ..... 482/1, 3, 8, 14, 482/74, 900–902; 434/247, 254, 255; 73/379.01; 340/323 R, 309.15, 384.71, 573

[56] References Cited

U.S. PATENT DOCUMENTS

| | | | |
|---|---|---|---|
| 3,492,582 | 1/1970 | Heywood | 482/3 X |
| 3,846,704 | 11/1974 | Bessette | 434/255 X |
| 4,028,693 | 6/1977 | Kuntz | 482/3 X |
| 4,186,388 | 1/1980 | Robinson . | |
| 4,334,190 | 6/1982 | Sochaczevski . | |
| 4,408,183 | 10/1983 | Wills . | |
| 4,449,114 | 5/1984 | Fascenda et al. | 340/323 R X |
| 4,510,485 | 4/1985 | Tahara . | |
| 4,536,739 | 8/1985 | Nobrita | 340/323 R |
| 4,578,769 | 3/1986 | Frederick | 340/323 R X |
| 4,728,100 | 3/1988 | Smith . | |
| 4,752,764 | 6/1988 | Peterson et al. . | |
| 4,774,679 | 9/1988 | Carlin | 482/902 X |
| 4,780,085 | 10/1988 | Malone . | |
| 4,785,282 | 11/1988 | Martell et al. | 340/323 R |
| 4,857,886 | 8/1989 | Crews . | |
| 4,885,797 | 12/1989 | Leather et al. | 340/323 R X |
| 4,911,427 | 3/1990 | Matsumoto et al. . | |
| 5,136,621 | 8/1992 | Mitchell et al. . | |
| 5,194,861 | 3/1993 | St. Clair | 340/323 R X |

*Primary Examiner*—Joe H. Cheng
*Attorney, Agent, or Firm*—William E. Hein

[57] ABSTRACT

An interactive exercise monitor which computes and displays time, distance, pace, and energy expended by a user performing a repetitive workout around a predetermined course employs a stationary transmitter located along the workout course and a receiver carried by the user. The stationary transmitter emits a limited range signal that is detected by the receiver each time the user passes the transmitter during the workout. The receiver includes a central processing unit into which the precise distance of the course may be preprogrammed and that is then capable of computing distance accumulated by the user, elapsed time, and other desired parameters. In addition, the user may enter information such as his or her weight and a desired time, distance, and pace of the workout into the receiver.

8 Claims, 9 Drawing Sheets

INTERACTIVE EXERCISE MONITOR

BACKGROUND OF THE INVENTION

This invention relates generally to exercise monitors and more particularly to an improved exercise monitor that records and displays to the user a number of exercise parameters, including time, distance, speed, and energy expended while walking, jogging or running repetitively along a predetermined course. The user may input information that serves to control the time, distance, and/or pace of exercise.

The most common prior art means employed by walkers and runners to obtain feedback information while they exercise is to mentally record and accumulate the number of course laps completed. Given the known distance of the course, the total distance covered can then be calculated. Using a stopwatch or timer, the user can determine the time spent during the workout and can compute the average speed. This method requires that the exerciser's total attention be focused on recording and accumulating completed laps for the duration of the workout. It is tedius, detracts from the enjoyment of the workout, and often leads to inaccuracies in the user's calculations.

A handheld mechanical counter may be carried by the user and manually activated once each lap to accumulate completed laps. However, these rudimentary devices are disadvantageous in that they require the attention of the user to insure accurate recording of each lap. Time and distance calculations must still be made mentally.

Exemplary of prior art electronic pedometers is that described in U.S. Pat. No. 4,334,190 to Sochaczevski. Such devices perform calculations of time, distance, speed, and energy expended. However, they determine distance traveled by sensing and accumulating the number of strides taken by the user. Thus, their accuracy depends on the stride length provided as an input by the user and the accuracy of the stride detecting mechanism. Since stride length varies from user to user, pedometers are not universally independent of user characteristics. Additional inaccuracy of these devices results from the fact that a given user's stride length is not maintained constant during a particular workout.

Other known devices for lap counting or position monitoring are those described in U.S. Pat. Nos. 4,780,085 to Malone, 4,857,886 to Crews, and 5,136,621 to Mitchell et al. Each of these devices relies upon a single, stationary sensing unit that incorporates a data processing unit. A signal from a transmitter worn by the user is received and processed by the sensing unit to provide the desired information. Since the processing unit is stationary, the computed parameters of interest are not available to the user on a real time basis. Also, the signal transmitter/receiver pair must be unique for each user, requiring multiple transmitter/receiver pairs for simultaneous use of the same track by multiple users.

It is therefore a principal object of the present invention to provide an interactive exercise monitor that computes and displays time, distance, pace, and energy expended by a user who walks or runs around a predetermined course.

It is a further object of the present invention to provide an interactive exercise monitor into which the user may enter desired values of workout time, distance to be traveled, and pace to be maintained.

These and other objects are accomplished in accordance with the illustrated preferred embodiment of the present invention by providing a stationary transmitter located along the workout course and a receiver carried by the user. The stationary transmitter emits a limited range signal that is detected by the receiver each time the user passes in close proximity to the transmitter during the workout. The receiver includes a central processing unit into which the precise distance of the course may be preprogrammed and that is then capable of computing distance accumulated by the user, elapsed time, and other desired parameters. In addition, the user may enter information such as his or her weight and a desired time, distance, and pace of the workout into the receiver.

DETAILED DESCRIPTION OF THE PREFERRED EMBODIMENT

Figure 1:
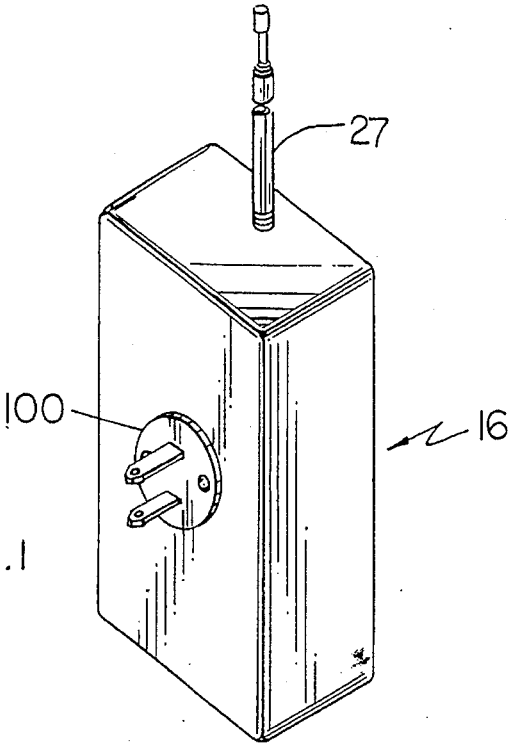
FIG. 1 is a pictorial diagram of a stationary transmitter employed in the interactive exercise monitor of the present invention.

Referring now to FIG. 1, there is shown a transmitter 16 that is functionally equivalent to a transmitter that may be purchased as an off-the-shelf component from Radio Shack under catalog number 60-4107, with minor modifications. These modifications include replacing the 9-volt battery with a conventional 12-volt D.C. power supply and shorting the transmitter switch to provide continuous transmission of an unmodulated radio frequency signal having a reception range of 15–20 feet. Transmitter 16 includes a telescoping antenna 27 and an A.C. power plug 100 that may be plugged into any convenient 120-volt A.C. power outlet near a point along a workout course at which it is desired to position transmitter 16.

Figure 2A:
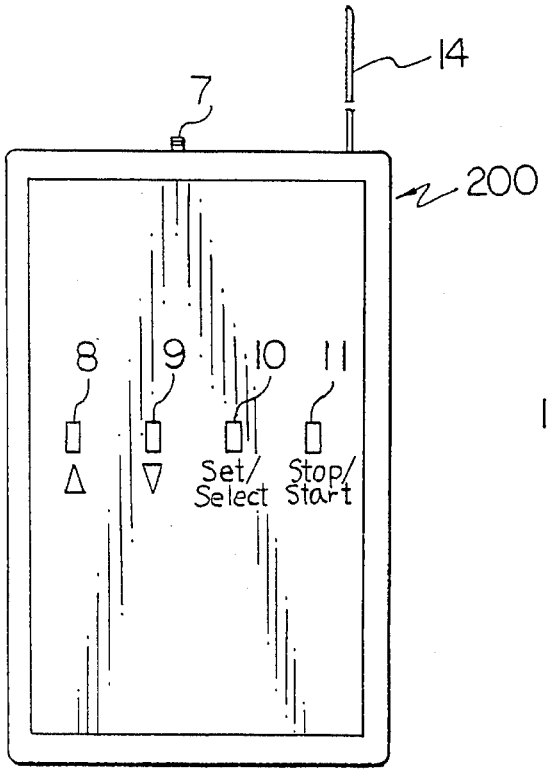
FIG. 2A is a pictorial diagram of a receiver carried by the user of the interactive exercise monitor of the present invention illustrating function switches actuable by the user.
Figure 2B:
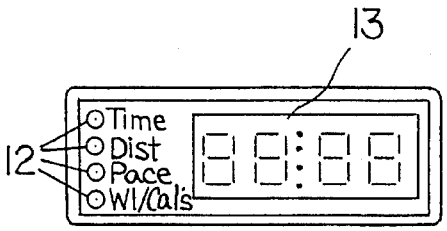
FIG. 2B is an end view of the receiver of FIG. 2A illustrating a plurality of function light emitting diodes (LEDs) and a numeric display.

Referring now to FIGS. 2A–B, there is shown a battery-powered receiver 200 that may be conveniently carried on the user's garment waistband by means of a belt clip or other conventional fastener. As described in detail below, receiver 200 senses the signal transmitted by fixed transmitter 16 each time the user passes in close proximity thereto and thereby counts the number of laps of the workout course traversed by the user. By preprogramming the length of the workout course into receiver 200, an accumulated distance may be computed by receiver 200. In order to precisely determine the course length, it is recommended that a measuring wheel be used. The measured course length is converted to miles and programmed into receiver 200 as an integer representing the course length in thousandths of a mile. For example, a ¼mile course length is programmed into receiver 200 as the integer 250. Receiver 200 includes a power switch 7, four function switches 8, 9, 10, 11, and a wire antenna 14. Receiver 200 also includes a four-digit, seven-segment liquid crystal display (LCD) 13 and four light emitting diodes (LEDs) 12 that serve as mode indicators.

Figure 3:
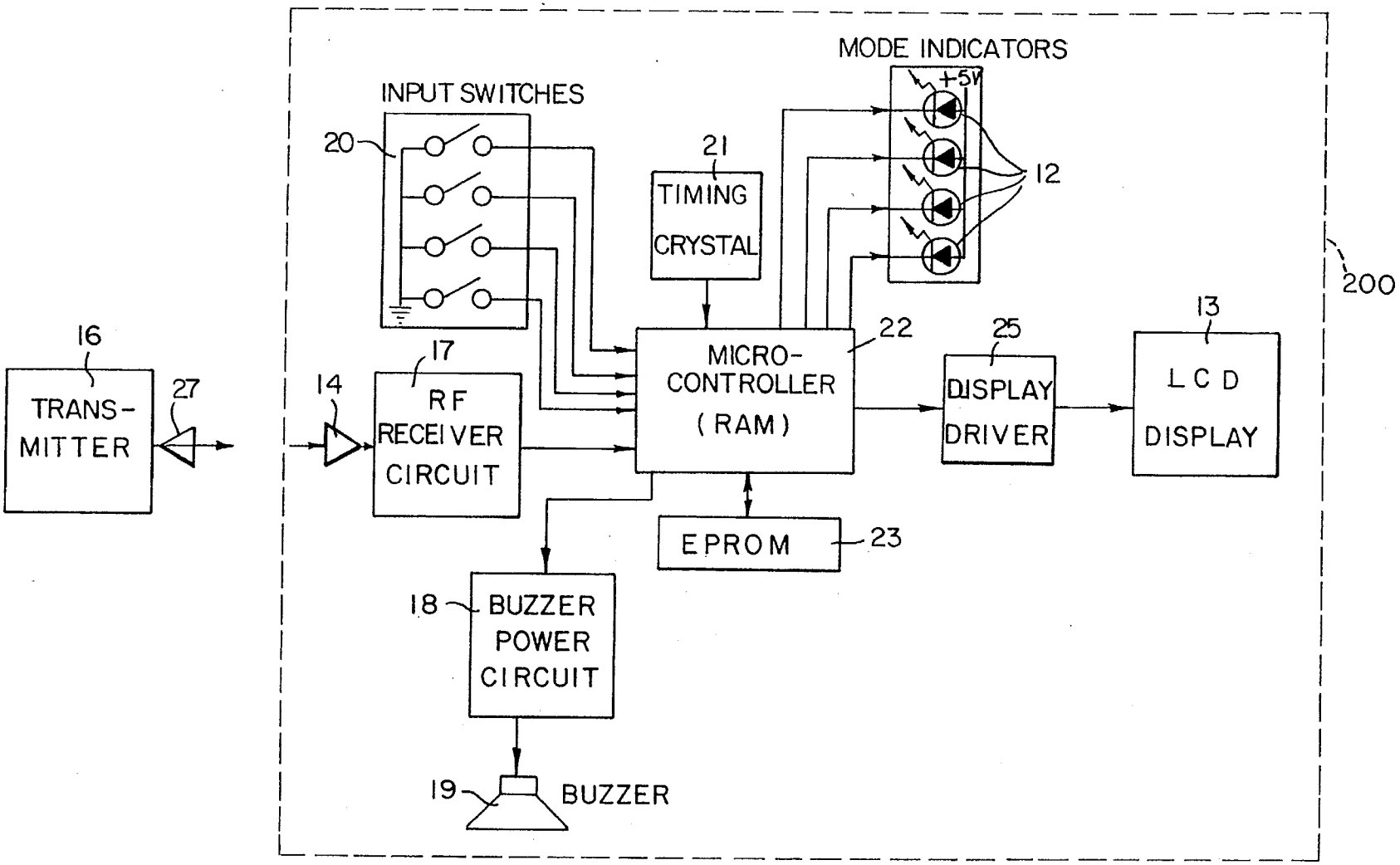
FIG. 3 is an overall circuit block diagram of the interactive exercise monitor of the present invention.
Figure 4A:
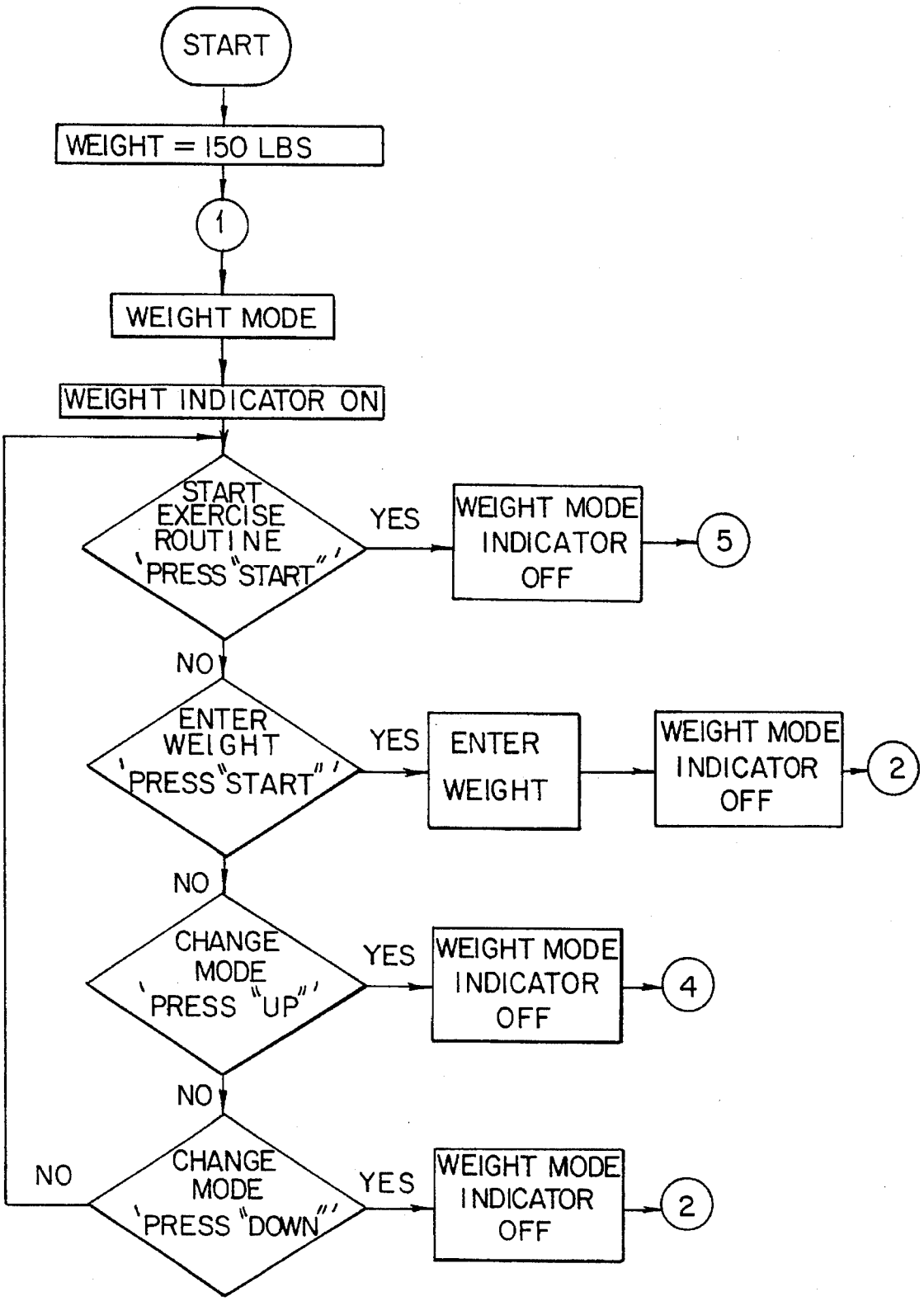
FIGS. 4A–4F are a flow chart of software routines executed by a microcontroller within the receiver of FIGS. 2A–B to perform selected counting and timing functions.
Figure 4B:
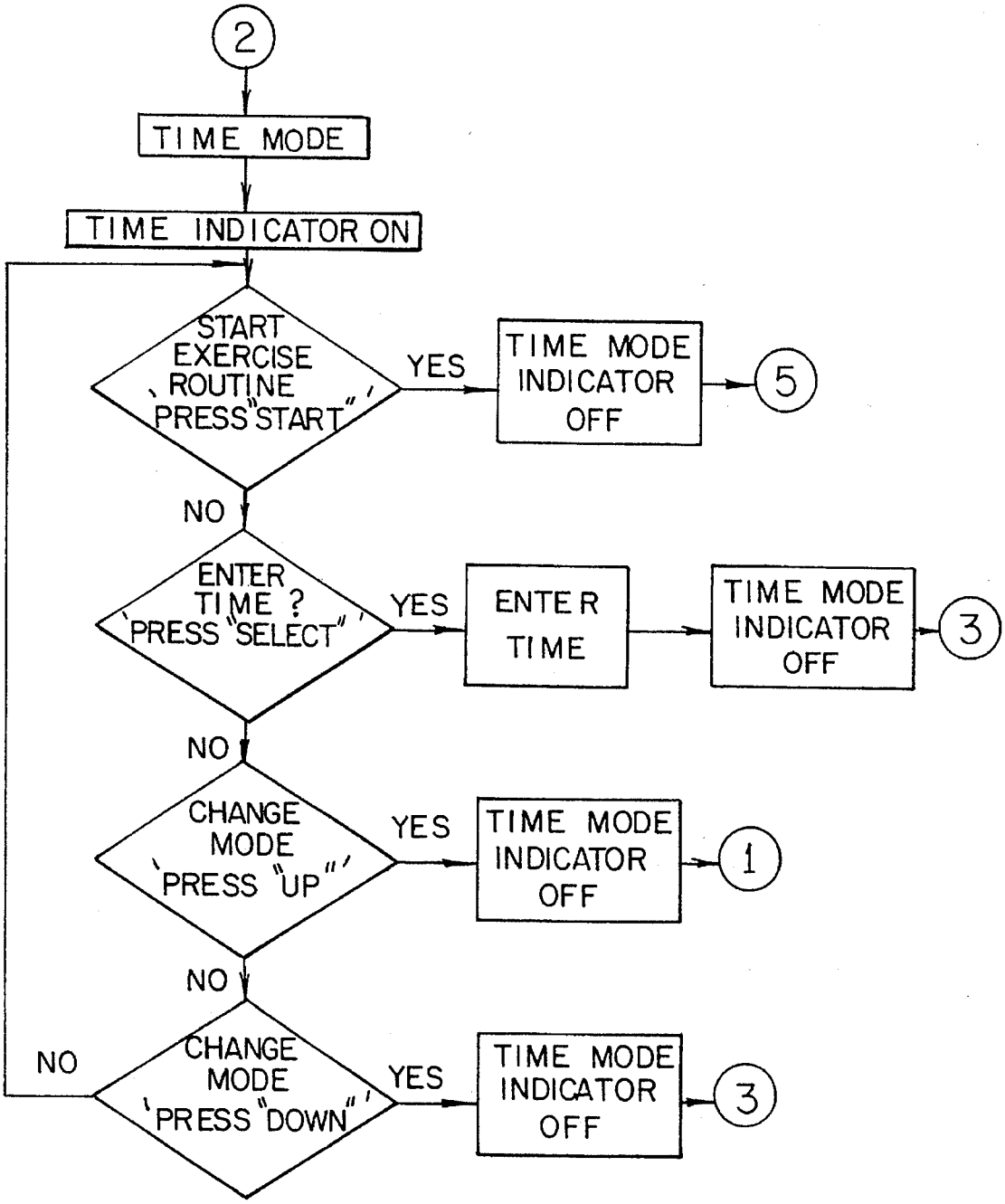
Figure 4C:
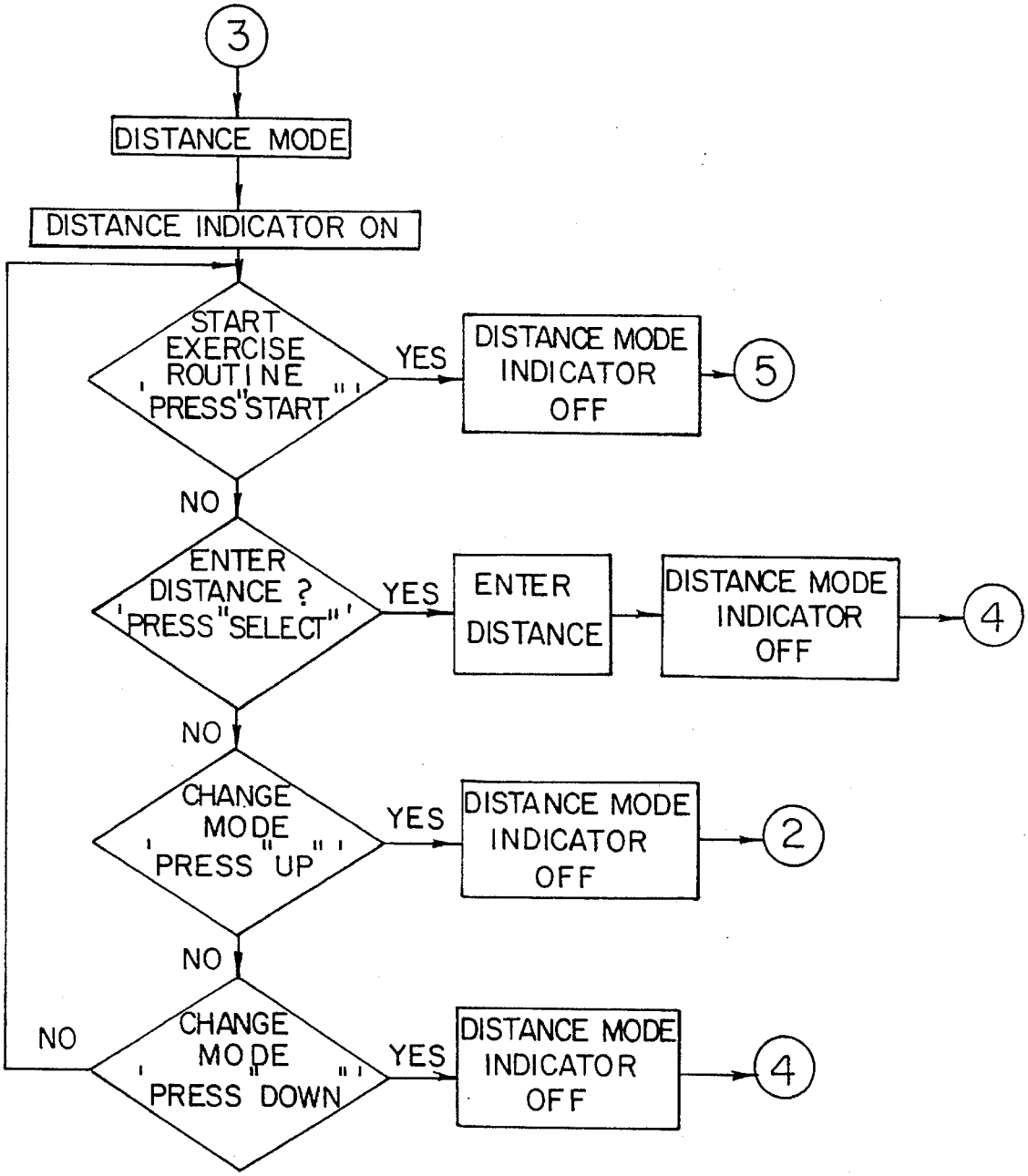
Figure 4D:
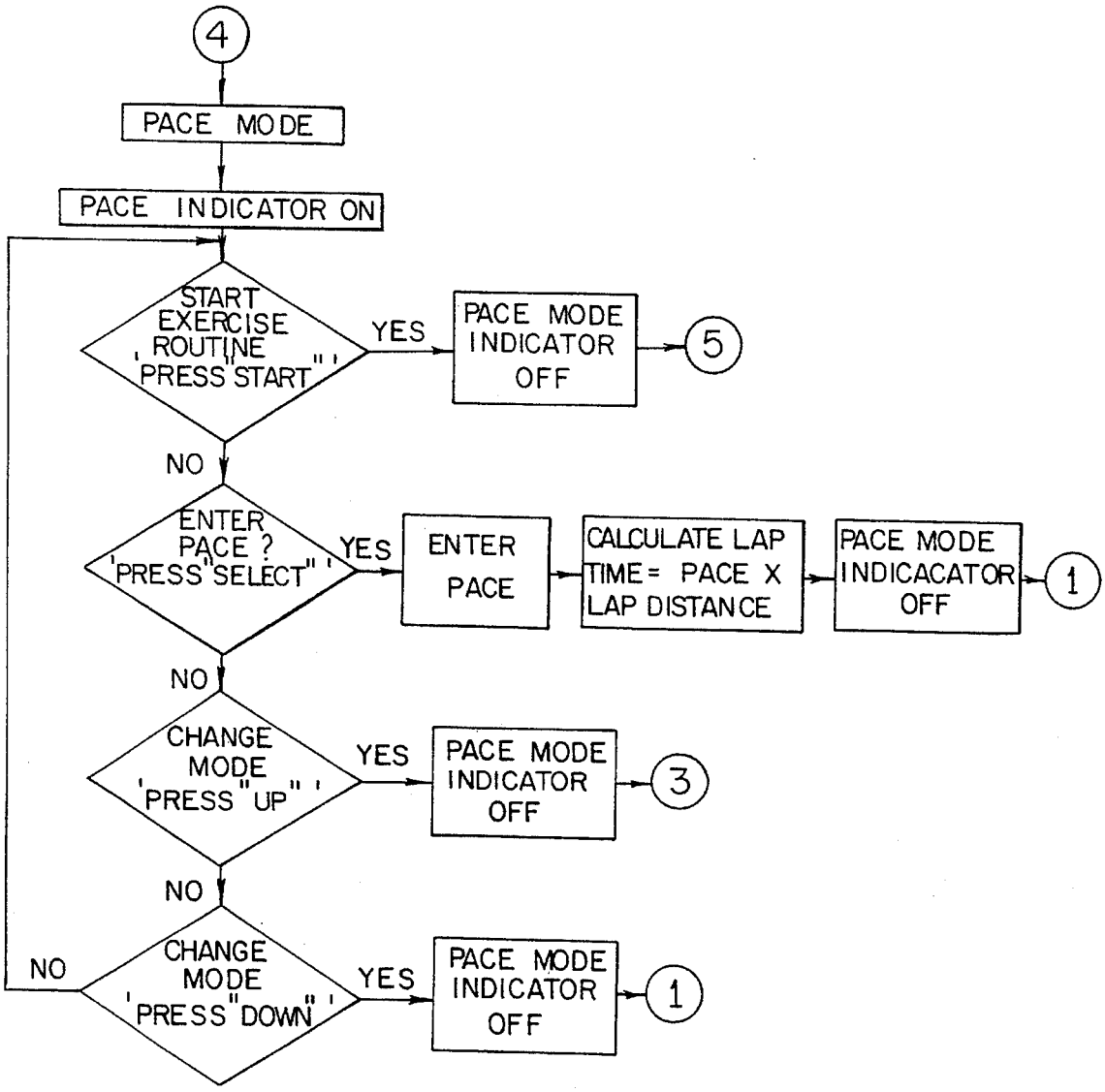
Figure 4E:
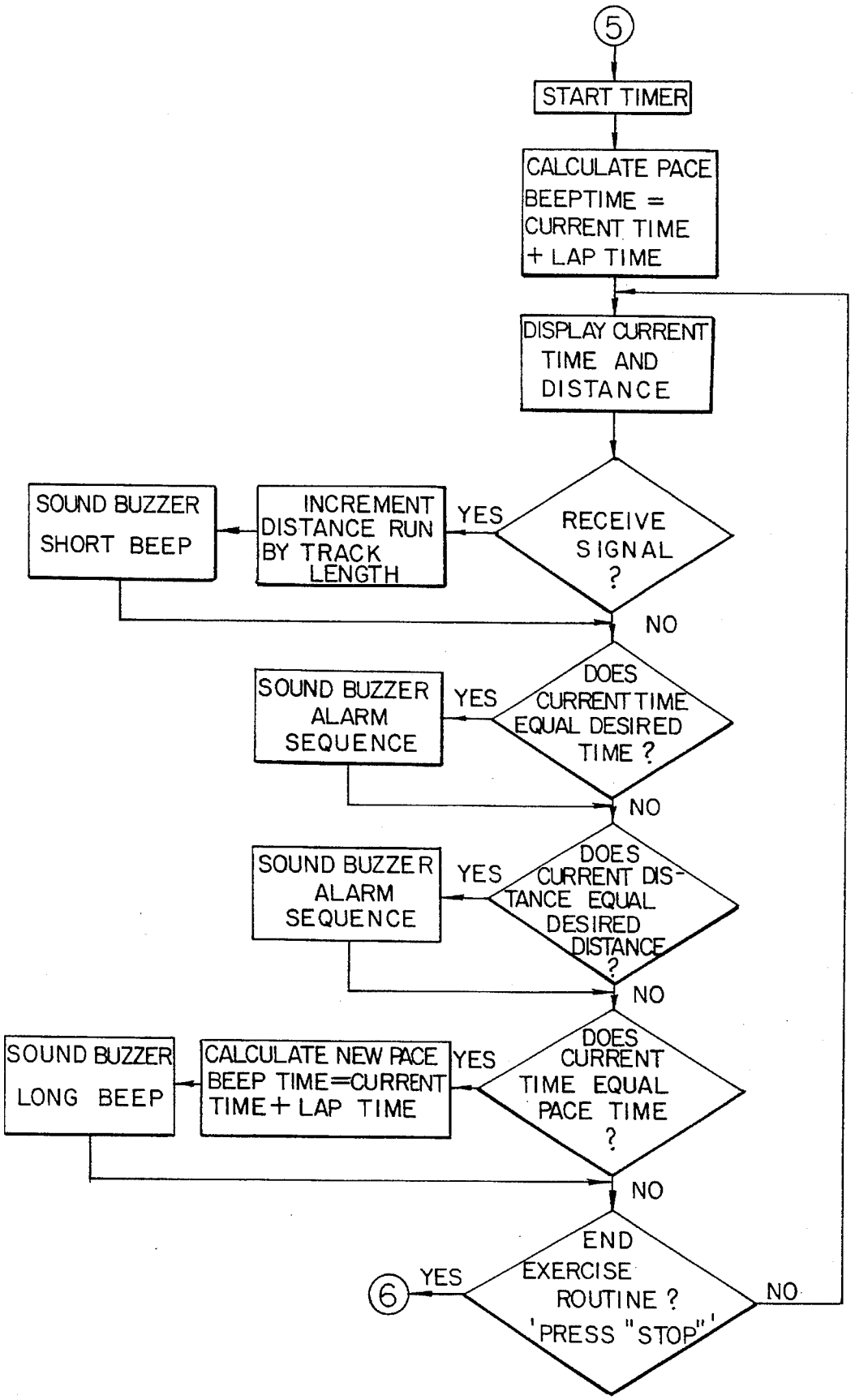
Figure 4F:
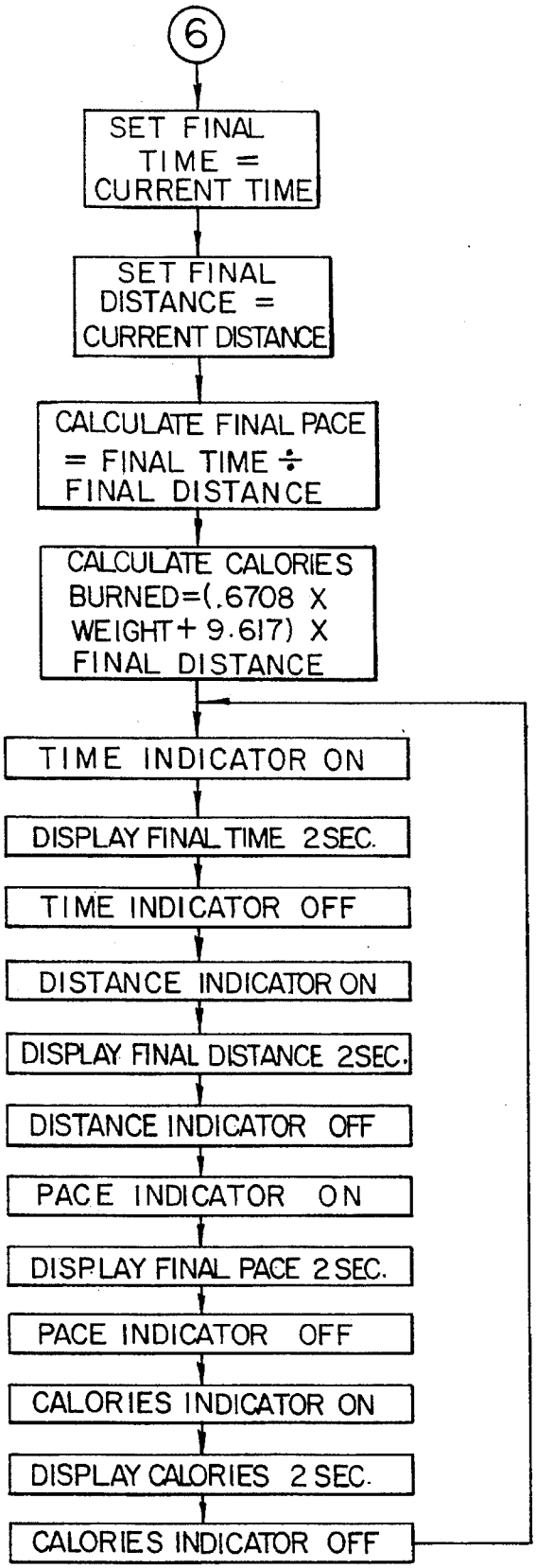

Operation of the interactive exercise monitor of the present invention may be understood with reference to FIGS. 2A–B and to the overall circuit block diagram of FIG. 3. Actuation of power switch 7 on receiver 200 applies battery power to the circuitry illustrated in FIG. 3 as being contained within receiver 200. A timing crystal 21 supplies timing pulses to a microcontroller 22, which executes the software routines of FIGS. 4A–F that are stored in an EPROM 23.

Referring now to the flow chart of FIGS. 4A–F, operation of receiver 200 begins in a WEIGHT mode 1 when power is applied. At this point, a Wt/Cals one of the mode indicator LEDs 12 begins flashing to indicate to the user that receiver 200 is in the WEIGHT mode. The user may elect to begin his or her workout routine immediately, without entering any values for weight, time, distance or pace by actuating Start/Stop function switch 11, in which case the default values of zero for time, distance, and pace and 150 for weight are used for subsequent calculations. When any of the function switches 8–11 is actuated, an associated I/O pin of microcontroller 22 is shorted to ground. When this change of state of one of the I/O pins is detected by microcontroller 22, the desired function is identified. If the Stop/Start function switch 11 is actuated by the user, the receiver 200 immediately begins executing the TRACKING routine 5 of FIG. 4E.

Set/Select function switch 10 is actuated to select the WEIGHT mode 1 in order to enable entry of the user's weight into receiver 200. The default weight value of 150 pounds is then displayed on LCD display 13 with the two most significant digits flashing. The user may then change this displayed default weight in 10-pound increments or decrements by actuating the UP or DOWN function swtiches 8, 9, respectively. Actuation of the Set/Select function switch 10 then holds the two most significant digits and causes the least significant digit of LCD display 13 to begin flashing. The user may now increment or decrement this least significant digit by again actuating the UP and DOWN function switches 8, 9. Actuation of Set/Select function switch 10 enters the user's weight into an internal RAM within microcontroller 22 and causes the display mode to change from WEIGHT mode 1 to TIME mode 2. In the event the user chooses to retain the default weight value (150 pounds), the display mode may be changed to the PACE mode 4 by actuating UP function switch 8 or to the TIME mode 2 by actuating the DOWN function switch 9.

Whenever a new display mode is selected, an associated one of the mode indicator LEDs 12 begins flashing to indicate the selected mode. The mode indicator LEDs 12 are connected to separate output pins of microcontroller 22 and are powered by a 5-volt battery supply. A particular one of the mode indicator LEDs 12 is caused to flash by alternating the state of the associated output pin between the supply voltage and ground. A flashing duty cycle of 0.1 is employed to conserve battery power.

Data for driving LCD display 13 is provided serially at a single output pin of microcontroller 22 in the form of a 32-bit stream to a display driver 25. Display driver 25 converts the serial display data to a parallel format for independent activation of each of the 32 display segments of LCD display 13.

When either the TIME mode 2, DISTANCE mode 3 or PACE mode 4 has been selected, the options for the user are the same as described above in connection with the WEIGHT mode 1. In each mode, the user may elect to begin a workout routine by actuating the Stop/Start function switch 11 to initiate the TRACKING routine 5, change the default value of the variable associated with that mode by actuating the Set/Select function switch 10, or select a new mode by actuating either of the UP and DOWN function switches 8, 9. The default values for time, distance, and pace are zero. When a value other than zero is entered for the pace variable, a lap time associated with the entered value is calculated using the expression: lap time=track length/pace. The lap time represents the time it will take for the user to complete one lap of the track and is also the time interval between pace beeps while the receiver 200 is in the TRACKING mode 5.

Figure 6:
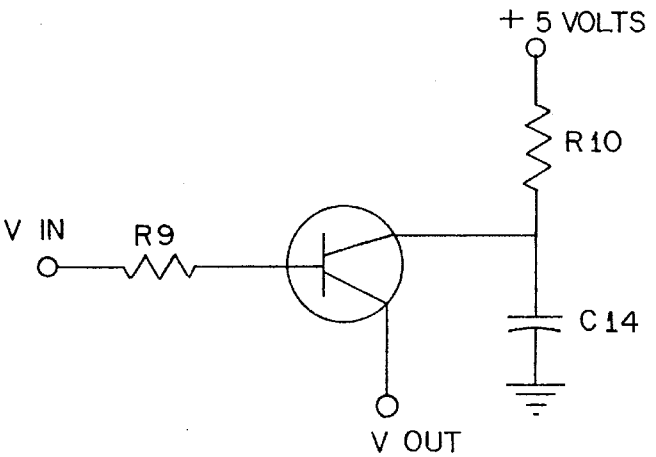
FIG. 6 is a detailed schematic diagram of circuitry comprising the buzzer power circuit of FIG. 3.

When the user has entered values for all of the variables and is ready to begin an exercise routine, the Stop/Start function switch 11 is actuated to start the tracking functions of receiver 200 in TRACKING mode 5. The tracking functions consist of timing, lap recognition, and accumulation and audible lap time feedback for pace control. A timer within microcontroller 22 begins timing when the Stop/Start function switch 11 is actuated. LCD display 13 displays the elapsed time of the workout in minutes and seconds and is updated every hundredth of a second. When the elapsed time is equal to the previously entered value for the time variable, a buzzer 19 is sounded in an alarm pattern to alert the user to the fact that the desired workout time has been reached. Buzzer 19 is driven by a buzzer power circuit illustrated in FIG. 6, which is activated by a signal from an output pin of microcontroller 22 at a frequency corresponding to that desired of the audible tone emitted by the buzzer 19.

A pace beep is sounded by buzzer 19 at time intervals equal to the pace lap time calculated by microcontroller 22 following entry by the user of a pace variable. When the TRACKING mode 5 has been selected, the pace lap time previously calculated in the PACE mode 4 is added to the current time, presently zero, to obtain the pace beep time. When the current time is equal to the pace beep time, a long beep is sounded by buzzer 19, and a new pace beep time is calculated by again adding the pace lap time to the current time. This process is repeated for the duration of the exercise routine.

Figure 5:
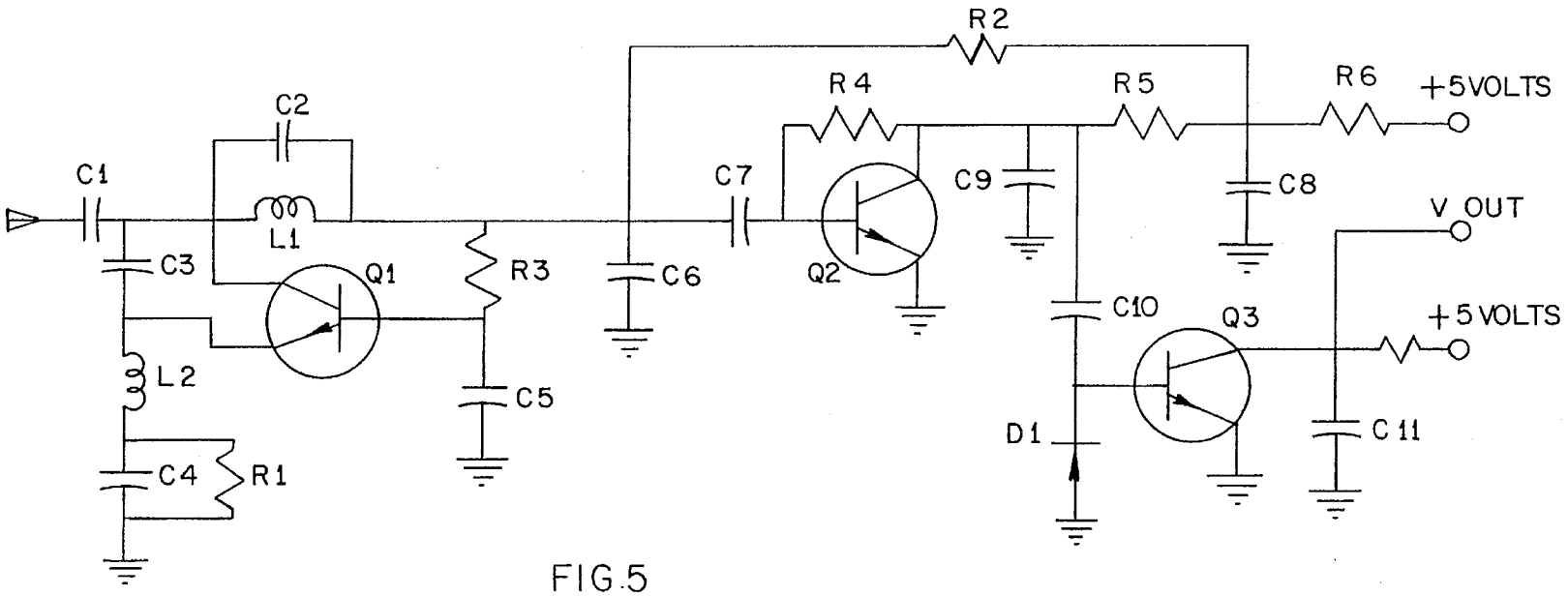
FIG. 5 is a detailed schematic diagram of circuitry comprising the R.F. receiver circuit of FIG. 3.

Referring now to FIG. 5, there is shown a detailed schematic diagram of circuitry comprising an R.F. receiver circuit 17 within receiver 200. R.F. receiver circuit 17 is of the super regenerative type that produces a DC output voltage of 5 volts during the time that the signal from transmitter 16 is not being detected and no output voltage during the time that the signal from transmitter 16 is detected as the user passes in close proximity thereto. Microcontroller 22 detects this change in output voltage of R.F. receiver circuit 17 and initiates a short beep sounded by buzzer 19 to indicate to the user that a lap of the workout course has just been completed. At the same time, microcontroller 22 adds one course length to the accumulated distance to obtain a current distance. This process continues for the duration of the workout. When the current distance equals or exceeds the previously entered distance value, buzzer 19 sounds to notify the user that the distance value has been reached.

When a workout has been completed, the user actuates the Stop/Start function switch 11 to initiate the FINAL DISPLAY mode 6. In this mode, the final time is set to equal the current time, and the final distance is set to equal the current distance. The final pace is calculated by dividing the final time by the final distance and converting the result to minutes per mile. A value for calories burned is calculated using the expression: calories burned=(0.6708 * weight+9.617) * final distance. The FINAL DISPLAY mode 6 then enters a continuous loop that operates to alternately display the values of the final time, final distance, final pace, and calories burned parameters for two seconds each on LCD display 13. The mode indicator LED 12 associated with the parameter being displayed flashes in coincidence with the two-second display duration. The FINAL DISPLAY mode 6 continues until the receiver 200 is turned off by the user through actuating of power switch 7.

It will be appreciated by those persons skilled in the art that numerous changes may be made to the above-described embodiment of the invention without departing from the spirit and scope thereof. For example, while receiver 200 has been described as being attached to a garment waistband, it may just as easily be worn on the wrist of the user. Although the invention has been described as utilizing an unmodulated radio frequency signal as a proximity signal, any continuously transmitted signal, whether modulated or unmodulated, and whether infrared, ultrasonic or magnetic in frequency may be utilized. It is also contemplated that the interactive exercise monitor of the present invention that has been described in connection with walking or running workouts may also be employed in connection with other types of repetitive exercise activities such as swimming or cycling.

I claim:

1. An interactive exercise monitor for use by a person performing a repetitive workout around a predetermined course, the interactive exercise monitor comprising:

a single unattended transmitter fixedly positioned at a point along the course, the transmitter being operative for continuously emitting a limited range signal; and receiver means carried by a user during a repetitive workout around said course, the receiver means being operative for detecting said limited range signal each time the user passes in proximity to said transmitter and for providing a signal to the user during each lap of said course only at the point at which the user passes in proximity to said transmitter.

2. An interactive exercise monitor as in claim 1 wherein said receiver means comprises:

microcontroller means preprogrammable with a course length and operative for computing a total workout distance as the product of the number of laps of said course traversed by the user and the course length, said microcontroller means being further operative for accumulating an elapsed workout time since the beginning of a workout by the user; and visual display means, coupled to said microcontroller means, for selectively displaying to the user the computed total workout distance and the accumulated elapsed workout time.

3. An interactive exercise monitor as in claim 2 wherein said receiver means further comprises:

function switch means, coupled to said microcontroller means, for enabling the user to enter a desired workout time and a pace value into said receiver means;

said microcontroller means being operative for comparing said elapsed workout time to said desired workout time and for providing a signal to the user when said elapsed workout time becomes equal to said desired workout time;

said microcontroller means being further operative for computing a lap time as the result of dividing said course length by said pace value and for providing a signal to the user at time intervals equal to the computed lap time.

4. An interactive exercise monitor as in claim 3 wherein:

said function switch means is operative for enabling the user to enter a user weight into said receiver means;

said microcontroller means is further operative, following completion of a workout by the user, for computing a number of calories burned by the user during the workout; and said visual display means is operative for displaying to the user the computed number of calories burned.

5. An interactive exercise monitor as in claim 4 wherein the number of calories burned is computed as follows: (0.6708 * user weight+9,617) * total workout distance.

6. An interactive exercise monitor as in claim 4 wherein:

said microcontroller means is further operative, following completion of a workout by the user, for computing a final pace as the result of dividing said elapsed workout time by said total workout distance; and said visual display means is operative for displaying to the user the computed final pace.

7. An interactive exercise monitor as in claim 6 wherein:

said function switch means is operative, following completion of a workout by the user, for enabling the user to initiate a final display mode of operation of said receiver means;

said microcontroller means is responsive to initiation of said final display mode of operation for causing said visual display means to continuously, alternately display to the user said elapsed workout time, said total workout distance, said final pace, and said number of calories burned.

8. An interactive exercise monitor as in claim 7 further comprising:

a plurality of mode indicators for indicating time, distance, pace, and calories display modes;

said microcontroller means being further operative, following initiation of said final display mode of operation, for sequentially illuminating each of said plurality of mode indicators in association with each display of said elapsed workout time, said total workout distance, said final pace, and said number of calories burned.

* * * * *